US008180083B2

(12) United States Patent
Campbell et al.

(10) Patent No.: US 8,180,083 B2
(45) Date of Patent: May 15, 2012

(54) PROTECTIVE COVER FOR BEHIND-THE-EAR HEARING AID DEVICE

(75) Inventors: Don E. K. Campbell, Winter Springs, FL (US); William Chiu, Longwood, FL (US)

(73) Assignee: Magnatone Hearing Aid Corp., Casselberry, FL (US)

( * ) Notice: Subject to any disclaimer, the term of this patent is extended or adjusted under 35 U.S.C. 154(b) by 505 days.

(21) Appl. No.: 12/496,726

(22) Filed: Jul. 2, 2009

(65) Prior Publication Data

US 2011/0002493 A1 Jan. 6, 2011

(51) Int. Cl.
*H04R 25/00* (2006.01)

(52) U.S. Cl. ..... 381/322; 381/330; 381/189

(58) Field of Classification Search ..... 381/322, 381/324, 327, 328, 330, 381, 189; 181/128, 181/129, 130, 135
See application file for complete search history.

(56) References Cited

U.S. PATENT DOCUMENTS 3,906,170 A * 9/1975 Guice ..... 381/322
5,249,234 A * 9/1993 Butler ..... 381/322

* cited by examiner

*Primary Examiner* — Huyen D Le
(74) *Attorney, Agent, or Firm* — Ice Miller LLP

(57) ABSTRACT

The present invention relates to a novel protective cover for over-the-ear or behind-the-ear hearing aid devices, wherein the protective cover is resistant to infiltration of moisture, corrosive elements, and/or dirt or debris. Furthermore, in at least one embodiment, the protective cover comprises a flexible material that offers a formed fit over the hearing aid device, and includes at least one slit within the flexible material such that the protective cover may be readily flipped up to allow access to portions of the over-the-ear or behind-the-ear hearing aid device upon which it is placed without significant effort by the user.

26 Claims, 5 Drawing Sheets

PROTECTIVE COVER FOR BEHIND-THE-EAR HEARING AID DEVICE

BACKGROUND

The present invention relates to Behind-the-Ear ("BTE") or On-the-Ear ("OTE") hearing aid devices. It will be appreciated that BTE/OTE hearing aid devices are placed in a manner such that the majority of the device sits on top of, or behind, the ear of the wearer. Such a placement is convenient for the wearer, and allows close proximity between the electronic portions of the BTE/OTE hearing aid device and the ear canal. However, such a placement exposes the electronic portions of a BTE/OTE hearing aid to moisture, dirt, sweat, and other elements that remain the main cause of damage or failure of all hearing devices. While improvements to digital processing, humidity resistant printed circuit flex boards and plastic fusion technology for sealing BTE/OTE hearing aid cases has improved resistance to these elements, BTE/OTE hearing aid devices are still susceptible to damage from the elements, including moisture intrusion. Such susceptible areas in new devices include the battery compartment/contacts, the ribbon cable programming slots and contacts, the programming socket, the push button memory switch, direct audio input ("DAI") connections, and dual direction microphone ports.

In an attempt to prevent moisture infiltration into these susceptible areas, devices and covers to seal or protect the OTE/BTE hearing aid devices have been created. For example, U.S. Pat. No. 5,249,234 to Butler discloses a flexible cover that must be stretched, for example with an expansion tool, to allow a hearing aid to be slipped into it, and then requires that the flexible cover be unrolled to remove the hearing aid. It will be appreciated that such a cover does not allow ready access to many portions of the hearing aid device, and difficulty in removing and/or re-applying such a cover is likely to prevent a wearer from either accessing the portions of the hearing aid device under the cover, which may prevent routine maintenance and fine tuning from being performed by the wearer. Further, when such a cover does not allow ready accessibility to the hearing aid device, such a cover is likely not to be replaced once it is removed, thereby losing any advantages of its tight fitting nature to repel moisture. Other attempts to solve the problem include U.S. Publication No 2004/0196996 that disclose hard covers for behind-the-ear hearing aids that are removable and "attractive", but which do not fully encapsulate the hearing aid to effectively protect against moisture infiltration. Likewise, U.S. Publication No 2008/0292124 discloses a rigid shield intended to preclude moisture from causing corrosion to the hearing aid by essentially acting as an umbrella that prevents rain or other falling debris from falling directly on an OTE/BTE hearing aid device. However, such a hard umbrella-like cover is obtrusive and still does not encapsulate the moisture prone areas of an OTE/BTE hearing aid device, thereby exposing those susceptible areas to moisture infiltration. As such, a protective cover that overcomes the shortcomings of the abovementioned art would be greatly appreciated.

SUMMARY

According to at least one embodiment, the present application relates to a hearing aid protection apparatus comprising a substantially hollow body comprising a water-resistant material, wherein the substantially hollow body has a first open end and a second substantially closed end, where the hollow body is sized and shaped to receive at least a portion of a hearing aid device through the first open end; a transverse cut is made through the water-resistant material substantially bisecting the substantially hollow body, the transverse cut sized such that the substantially hollow body hinges between a front end and a rear end of the hollow body, thereby allowing the rear portion of the hollow body to be removably placed on a rear portion of the hearing aid device while the front end of the hollow body is maintained upon the hearing aid device. Optionally, the hearing aid protection apparatus utilizes a flexible or semi-flexible material for the water-resistant material. According to another optional embodiment, the hearing aid protection apparatus utilizes a water-resistant material such as vinyl, rubber, neoprene, silicone rubber, neoprene, latex, or viton. As a further optional embodiment, the hearing aid protection apparatus utilizes a water-resistant material comprising a thickness of approximately 0.010" to approximately 0.040".

Additionally, according to at least one optional embodiment, the hearing aid protection apparatus comprises at least one hole formed through the water-resistant material, the at least one hole formed such that the transverse cut originates or ends within the hole. In another optional embodiment, the hearing aid protection apparatus of claim 1, further comprises a first hole and a second hole formed through the water-resistant material, the first hole formed in the substantially water-resistant material such that the transverse cut originates within the first hole, and the second hole formed in the substantially water-resistant material such that the transverse cut terminates within the second hole. In another optional embodiment, the first and second hole are sized and shaped to correspond to a microphone port on the hearing aid device. Additionally, the hearing aid protection apparatus of optionally comprises at least one raised area sized and shaped to receive a corresponding user control element from the hearing aid device when the substantially hollow body is placed over the hearing aid device. Further optionally, in the hearing aid protection apparatus the first open end is shaped at an angle to a substantially longitudinal axis running through the substantially hollow body such that the hearing aid device may be inserted through the first open end without the use of a tool.

Additionally, according to at least one additional optional embodiment, the hearing aid protection apparatus utilizes the transverse cut through the water-resistant material to produce an opening in the hollow body that allows the hearing aid device to be inserted through the opening into the hollow body without the use of a tool. According to at least one additional embodiment, the hearing aid protection apparatus of further includes the first open end shaped at an angle to a substantially longitudinal axis running through the substantially hollow body such that the hearing aid device may be inserted through the first open end without the use of a tool. According to at least one additional embodiment, the substantially closed end of the substantially hollow body substantially envelops the rear portion of the hearing aid device when the hearing aid protection apparatus is in a substantially closed position. According to at least one additional embodiment, the hearing aid protection apparatus is substantially impervious to water infiltration when the hearing aid protection apparatus is in the substantially closed position.

According to at least one embodiment, the present application relates to a hearing aid protection apparatus comprising a substantially hollow body comprising a water-resistant material having a thickness of approximately 0.010" to approximately 0.040"; wherein the substantially hollow body has a first open end substantially sized and shaped to receive at least a portion of a hearing aid device, and a second substantially closed end operable to substantially envelop a rear portion of the hearing aid device; and the hollow body includes a transverse cut through the water-resistant material substantially bisecting the substantially hollow body, the transverse cut sized such that the remaining water-resistant material forms a hinge in the substantially hollow body whereby the substantially closed end of the substantially hollow body may be flipped up to expose the rear portion of the hearing aid device while the first open end of the substantially hollow body is maintained around the hearing aid device.

According to another optional embodiment, the hearing aid protection apparatus utilizes a water-resistant material such as vinyl, rubber, neoprene, silicone rubber, neoprene, latex, or viton.

Additionally, according to at least one optional embodiment, the hearing aid protection apparatus comprises at least one hole formed through the water-resistant material, the at least one hole formed such that the transverse cut originates or ends within the hole. In another optional embodiment, the hearing aid protection apparatus of claim 1, further comprises a first hole and a second hole formed through the water-resistant material, the first hole formed in the substantially water-resistant material such that the transverse cut originates within the first hole, and the second hole formed in the substantially water-resistant material such that the transverse cut terminates within the second hole. In another optional embodiment, the first and second hole are sized and shaped to correspond to a microphone port on the hearing aid device. Additionally, the hearing aid protection apparatus of optionally comprises at least one raised area sized and shaped to receive a corresponding user control element from the hearing aid device when the substantially hollow body is placed over the hearing aid device. Further optionally, in the hearing aid protection apparatus the first open end is shaped at an angle to a substantially longitudinal axis running through the substantially hollow body such that the hearing aid device may be inserted through the first open end without the use of a tool.

Additionally, according to at least one additional optional embodiment, the hearing aid protection apparatus utilizes the transverse cut through the water-resistant material to produce an opening in the hollow body that allows the hearing aid device to be inserted through the opening into the hollow body without the use of a tool. According to at least one additional embodiment, the hearing aid protection apparatus of further includes the first open end shaped at an angle to a substantially longitudinal axis running through the substantially hollow body such that the hearing aid device may be inserted through the first open end without the use of a tool. According to at least one additional embodiment, the substantially closed end of the substantially hollow body substantially envelops the rear portion of the hearing aid device when the hearing aid protection apparatus is in a substantially closed position. According to at least one additional embodiment, the hearing aid protection apparatus is substantially impervious to water infiltration when the hearing aid protection apparatus is in the substantially closed position. According to at least one additional embodiment, the hearing aid protection apparatus further allows at least one operational feature on the hearing aid device to be accessible to a user when the substantially closed end of the substantially hollow body is flipped up to expose the rear portion of the hearing aid device.

According to at least one embodiment, the present application relates to a hearing aid protection apparatus comprising a substantially hollow body comprising a water-resistant material; the substantially hollow body having a first substantially closed end and a second substantially closed end, said hollow body sized and shaped to envelop a hearing aid device within the hollow body; and a transverse cut through the water-resistant material substantially bisecting the substantially hollow body, the transverse cut sized such that the substantially hollow body hinges between a front end and a rear end of the hollow body, thereby allowing the hearing aid device to be inserted into the hollow body such that a front portion of the hearing aid device is enveloped within the hollow body, and the rear end of the hollow body may be removably placed on a rear portion of the hearing aid device while the front end of the hollow body is maintained upon the hearing aid device.

DESCRIPTION

Figures 1, 2:
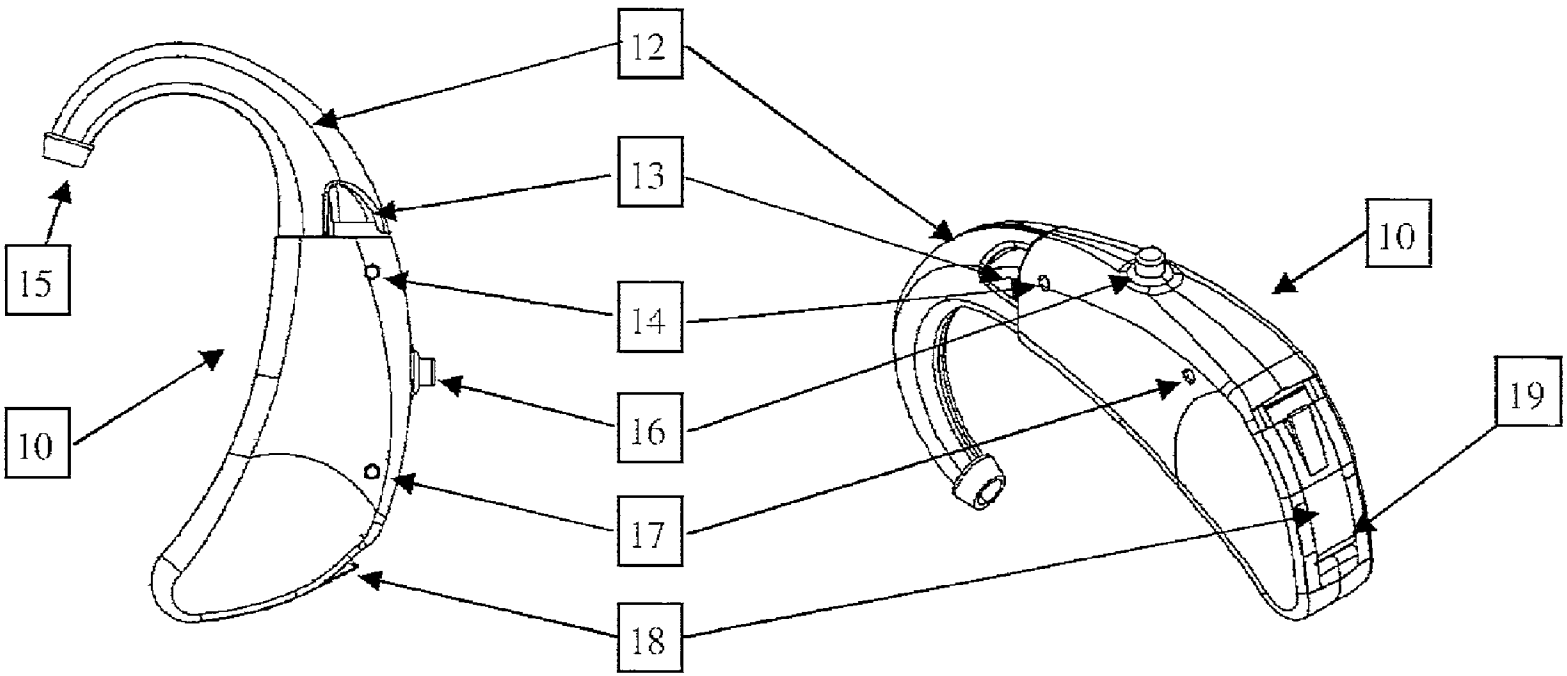
FIG. 1 is a side plan view showing a typical BTE or OTE hearing aid.
FIG. 2 is a rear/side perspective view showing a typical BTE or OTE hearing aid.

Turning to FIGS. 1 and 2, an illustrative example of a typical BTE or OTE hearing aid is provided for exemplary purposes only. As shown therein, a hearing aid device 10 comprises an ear hook 12 having a tip 15 wherein a sound tube (not shown) inserts into the ear hook 12 at one end and the sound tube inserts into the ear canal of a user at another end; a receiver outlet 13, at least one front microphone port 14 operable to pick up ambient sounds for amplifying; a memory push button 16 operable to allow a user to select certain preset settings for the hearing aid device 10, at least one optional rear microphone port 17, a battery compartment 18, and a programming slot 19 wherein a ribbon cable may be inserted for programming. It will be appreciated that other embodiments of a hearing aid device 10 exist, with additional features and components, and that the exemplary illustration herein does not limit the embodiments below, but is offered as an example only, and many different models and variants fall within the general description of a hearing aid device 10.

In operation, a hearing aid device 10 comprises a front microphone port 14 and/or rear microphone port 17 for receiving ambient sounds for amplifying, and amplifier (not shown) that is internal to the hearing aid device, and receiver outlet 13. Likewise, a hearing aid device 10 may include other optional controls such as a volume control and/or trim pots, telephone coils, or other features. In general, these components are incorporated in, or encapsulated by, a plastic housing which is worn on the upper rear part of a patient's ear. Once ambient sound is picked up by a front microphone port 14 or rear microphone port 17, the sound is amplified and/or selectively amplified by the amplifier, and transmitted through the ear hook 12 to a sound tube to a custom ear mold or an open-fit or occluded ear bud into patient's ear canal.

Figure 3:
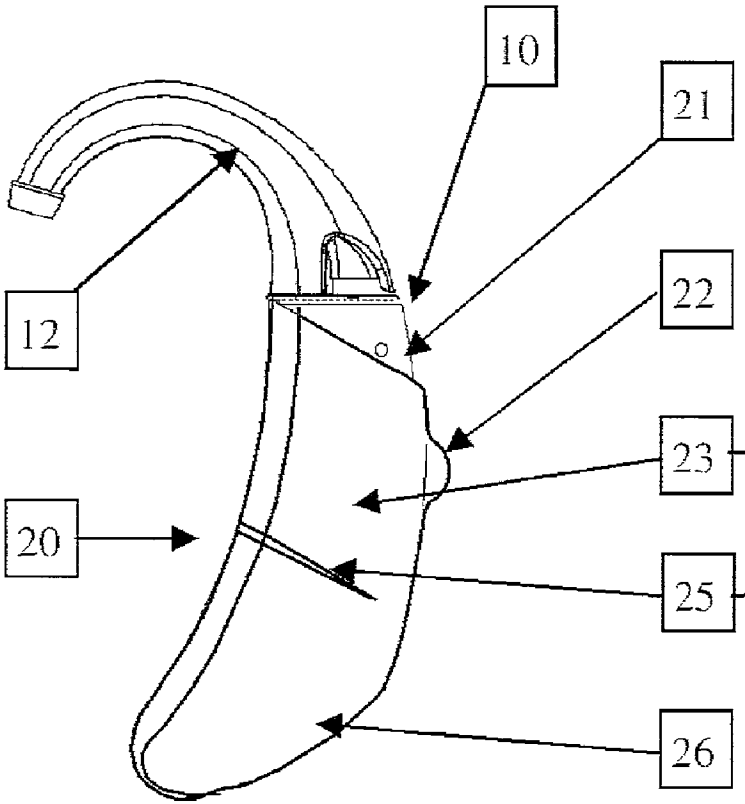
FIG. 3 is a side plan view of a protective cover for BTE or OTE hearing aids according to one embodiment, with the cover flap being in the down or protective position.

Turning now to FIG. 3, according to at least one embodiment, a protective glove or envelope 20 for a hearing aid device 10 comprises a flexible or semi-flexible material sized and shaped to substantially encapsulate a hearing aid device 10. For example, protective glove or envelope 20 optionally comprises vinyl, rubber, neoprene, silicone or other rubbers, neoprene, latex, viton or other water-resistant, water-proof, or water-impermeable material. Further optionally, protective glove or envelope 20 optionally comprises a water resistant or water-proof material that is air permeable, such as a treated nylon cloth (such as rip stop nylon or other woven nylon) or a treated flexible cloth that may comprise a fiber such as elastane (a.k.a. SPANDEX®). Further, the thickness of the material utilized for protective glove or envelope 20 may optionally range from approximately 0.010" to approximately 0.040" based on the type of material used and its durability. Additionally, it should be noted that the material may be, but need not be of a highly elastic material, and may be considered a hollow tube or cocoon in form such that it allows insertion of a BTE/OTE hearing aid device 10 to be placed within its protective environment.

Figure 4:
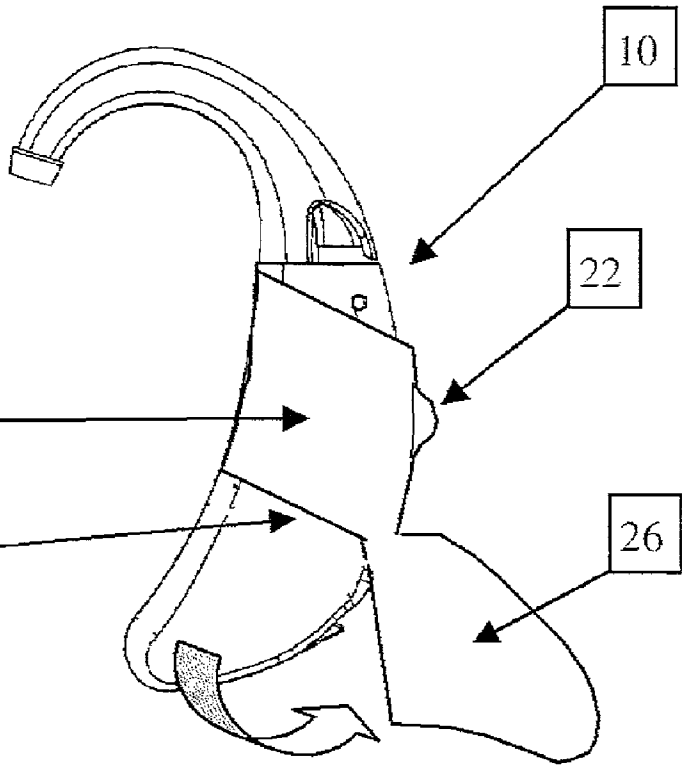
FIG. 4 is a side plan view of a protective cover for BTE or OTE hearing aids according to one embodiment, with the cover flap being in the up, or accessible position

Referring again to FIGS. 3 and 4, according to at least one embodiment, protective glove or envelope 20 includes a transverse cut 25 through a portion of substantially tubular protective glove or envelope 20 such that the transverse cut 25 divides protective glove or envelope into a front portion 23 and a back portion 26, wherein the transverse cut 25 allows the back portion 26 to be flipped upward and away from a corresponding back portion of a hearing aid device 10. FIG. 3 shows protective glove or envelope 20 encapsulating a hearing aid device 10, and in a substantially closed position such that the back portion of hearing aid device 10 is covered by the back portion 26 of protective glove or envelope 20. Conversely, FIG. 4 shows protective glove or envelope 20 in a substantially open position such that the back portion of hearing aid device 10 is no longer encapsulated by back portion 26 of protective glove or envelope 20, thereby allowing access to certain features of hearing aid device 10 that are not accessible when the protective glove or envelope 20 is in its substantially closed position. According to at least one aspect, protective glove or envelope 20 is able to be flipped up to expose the BTE/OTE hearing aid device 10 without the use of a tool or aid to expose at least a portion of the BTE/OTE hearing aid device 10 to access certain features and/or functions such as daily power up/down, battery replacement, DAI connections, etc. of the BTE/OTE hearing aid device 10.

In at least one optional embodiment, protective glove or envelope 20 is shaped as a substantially tubular sleeve having a front portion 23 with an opening to receive a hearing aid device 10 and a back portion 26 that is enclosed to substantially envelop a back portion of hearing aid device 10. According to at least one embodiment, the front portion 23 having an opening to receive a hearing aid device 10 comprises an angled opening 21 to aid in sliding the back portion of hearing aid device 10 through the opening of front portion 23 of protective glove or envelope 20. Likewise, the angled opening 21 may be sized and shaped to ensure that any front microphone port 14 of hearing aid device 10 is not covered by protective glove or envelope 20, thereby blocking entry of ambient sounds into hearing aid device 10.

According to at least one additional optional embodiment, protective glove or envelope 20 further comprises one or more blisters 22 molded therein to facilitate activation of any buttons, such as a memory push button 16, that may exist on hearing aid device 10, thereby allowing memory push button to be depressed and activated through protective glove or envelope 20, and allowing memory push button 16 to return to its upright position after being depressed. Furthermore, while hearing aid device 20 is sized and shaped to substantially encapsulate a hearing aid device 10, such a fit can, but need not be, made to exceptionally close tolerances, as angled opening 21 allows hearing aid device 10 to be inserted without the use of tools to stretch protective glove or envelope 20 during initial installation.

Figures 5, 6:
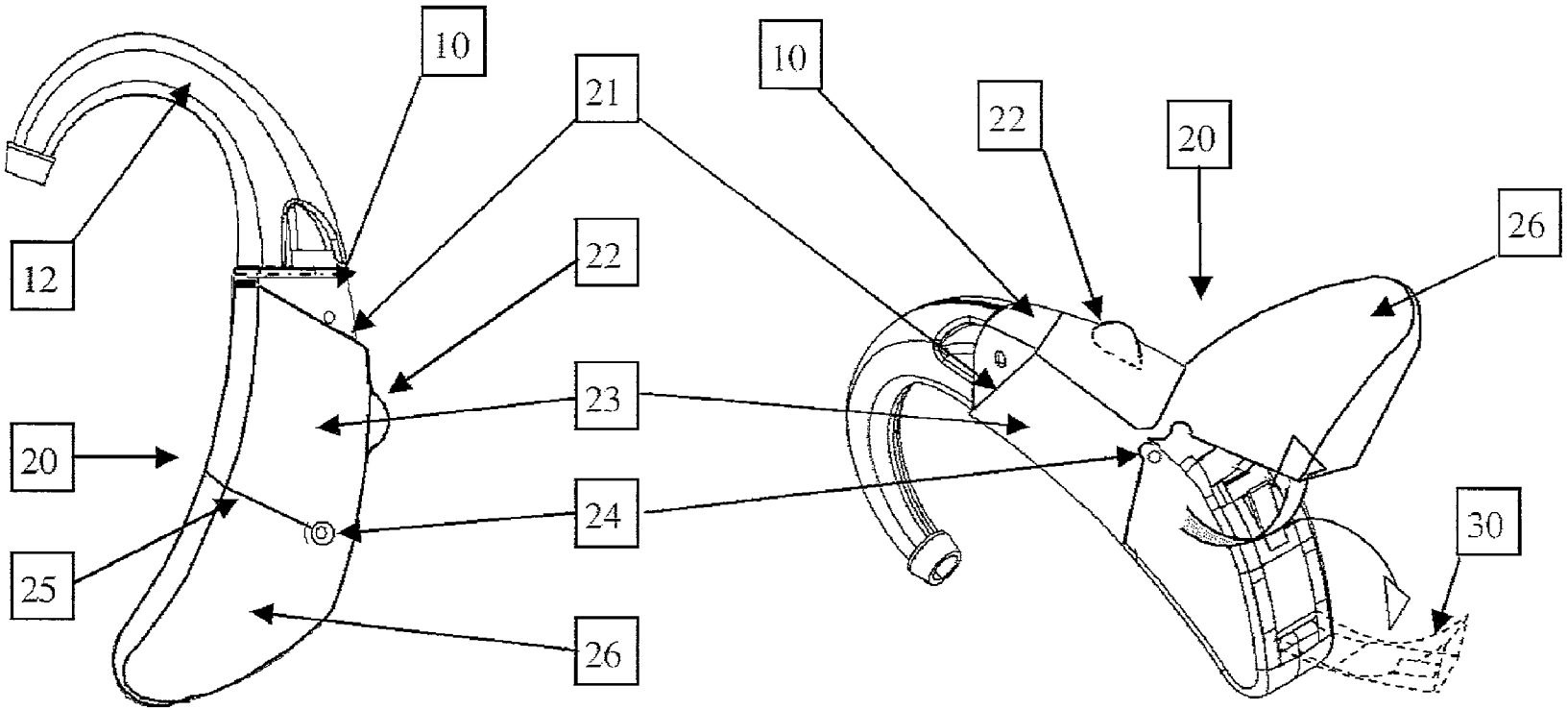
FIG. 5 is a side plan view of a protective cover for BTE or OTE hearing aids according to one embodiment, with the cover flap being in the down or protective position.
FIG. 6 is a rear perspective view is a side plan view of a protective cover for BTE or OTE hearing aids according to one embodiment, with the cover flap being in the up, or accessible position

Turning now to FIGS. 5 and 6, in at least one additional optional embodiment, protective glove or envelope 20 further comprises one or more holes 24 at the termination of transverse cut 25, thereby reducing the likelihood that transverse cut will tear or rip all the way across the cross section of protective glove or envelope 20. Furthermore, the one or more punched holes at the termination of transverse cut 25 provide a more free movement of the remaining material connecting front portion 23 and a back portion 26, which can be helpful when protective glove or envelope 20 comprises a semi-flexible or thick material. In at least one optional embodiment, the one or more punched holes may be strategically placed such that the holes 24 coincide with the rear microphone ports 17 for the particular hearing aid device 10, such that the transverse cut 25 originates and/or ends in the one or more holes 24 that coincide with rear microphone ports 17.

According to at least one optional embodiment, the transverse cut 25 and one or more holes 24 are sized and located such that the back portion 26 of protective glove or envelope 20 covers key openings in the plastic shell of hearing aid device 10 when protective glove or envelope 20 is in its substantially closed position, thereby preventing moisture infiltration when protective glove or envelope 20 is in its substantially closed position.

In at least one optional embodiment, protective glove or envelope 20 is shaped substantially as a hollow cocoon, or is substantially shaped to resemble the hearing aid device 10 which it will cover. According to at least one embodiment, protective glove or envelope 20 includes a transverse cut 25 through a portion of substantially tubular protective glove or envelope 20 such that the transverse cut 25 divides protective glove or envelope into a front portion 23 and a back portion 26, wherein the transverse cut 25 allows the back portion 26 to be flipped upward and away from a corresponding back portion of a hearing aid device 10. It will be appreciated that hearing aid device 20 may be inserted into protective glove or envelope 20 through the opening formed by transverse cut 25 such that the front portion of hearing aid device 10 may be urged into front portion 23, and then back portion 26 is hinged over the rear portion of hearing aid device 10. While such an insertion may be utilized for other embodiments described herein, it will be appreciated that when no front opening is present, such as in the above-described cocoon-like embodiment, utilizing the opening formed by transverse cut 25 is preferred. In addition, even when such a front opening is present, the front opening may optionally be sized and shaped such that the back portion of hearing aid device will not fit through the front opening, such that insertion of hearing aid device 10 may be achieved by inserting the front of hearing aid device 10 into the opening formed by transverse cut 25 into front portion 23, then hinging back portion 26 over the rear portion of hearing aid device 10.

Further, according to at least one additional embodiment, protective glove or envelope 20 further comprises one or more directional covers 22 molded therein and having a hole therethrough to act as a directional shield to substantially cover one or more corresponding microphone ports on the top or front of hearing aid device 10 from rain or other water, with the direction of the hole acting as a directional microphone port, typically facing the front of hearing aid device 10.

Figure 7:
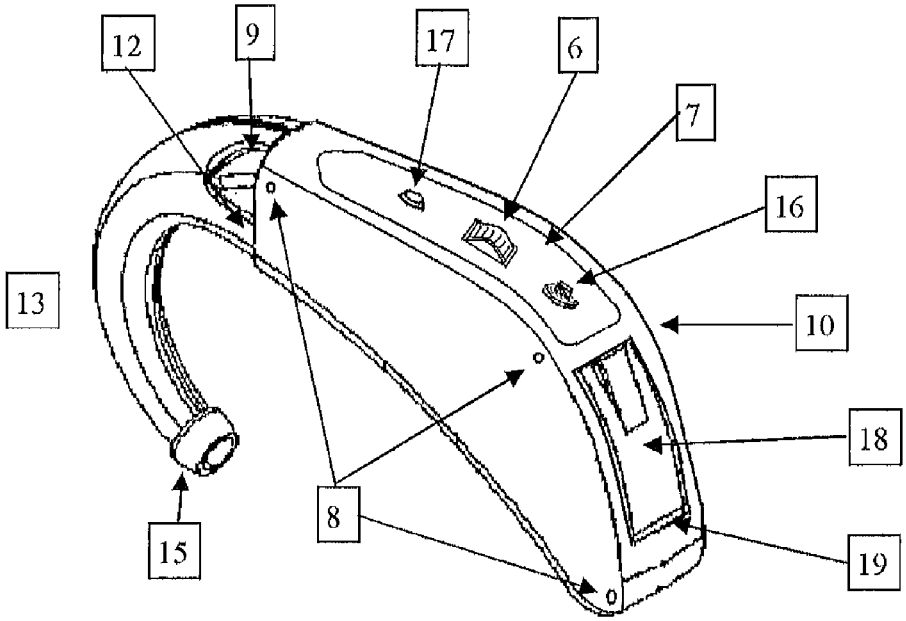
FIG. 7 is a perspective view of a protective cover for BTE or OTE hearing aids according to one embodiment, the protective cover having at least one directional opening for a microphone port.
Figure 8:
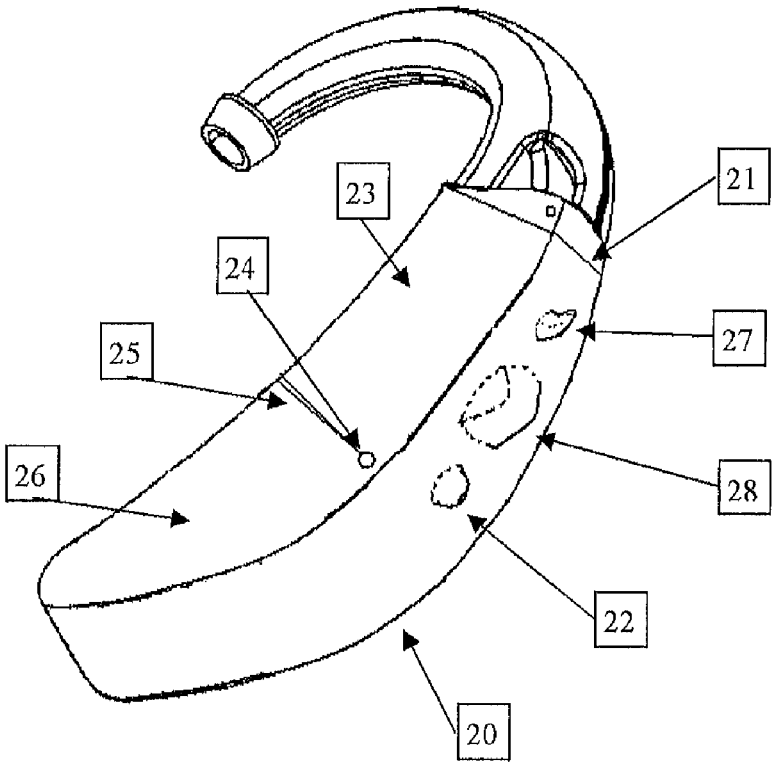
FIG. 8 is a perspective view of a protective cover for BTE or OTE hearing aids according to one embodiment, the protective cover having at least one directional opening for a microphone port.

Turning now to FIGS. 7 and 8, in at least one additional optional embodiment, protective glove or envelope 20 further comprises one or more directionally-formed openings 27 corresponding to microphone ports such as a rear microphone port 17, thereby substantially protecting the microphone port from moisture invasion while allowing sound to the microphone port through the directionally formed openings 27. It will be appreciated that most of the one or more directionally-formed openings 27 will be formed to face the front of hearing aid device 10, as most find it preferable to direct hearing from the direction they are facing.

Figure 9:
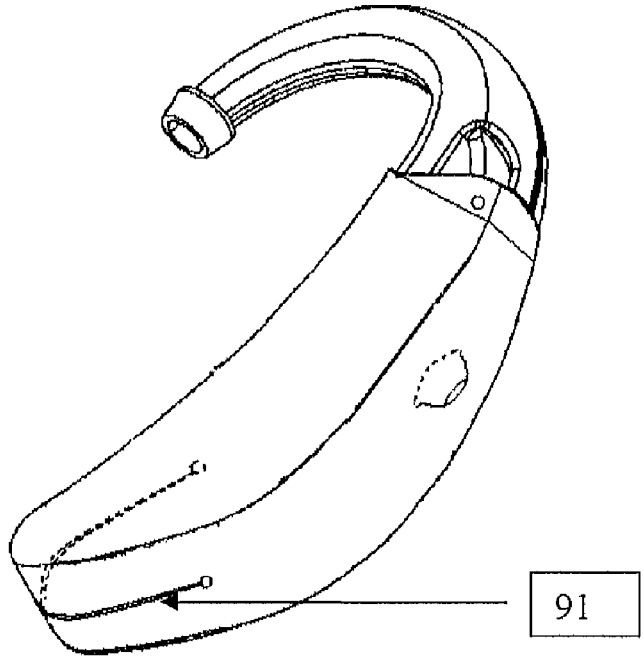
FIG. 9 is a perspective view of a protective cover for BTE or OTE hearing aids according to one embodiment, the protective cover having at least one slit in the rear portion of the protective cover to allow access to the hearing aid.
Figure 10:
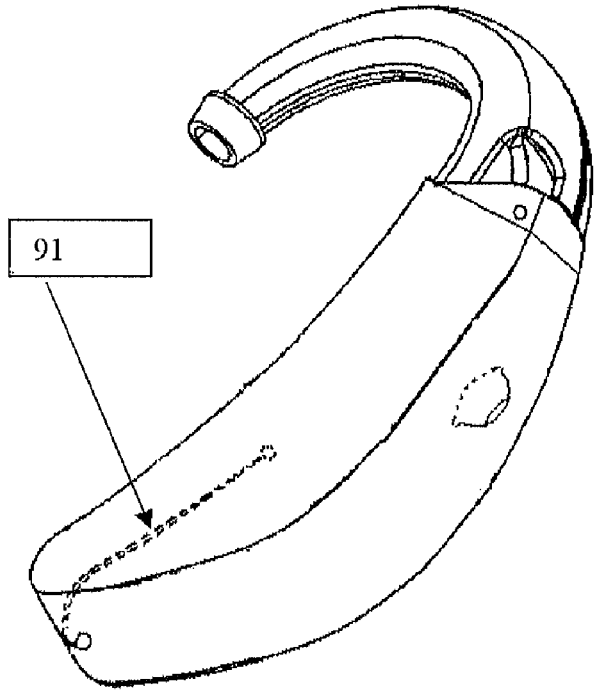
FIG. 10 is a perspective view of a protective cover for BTE or OTE hearing aids according to one embodiment, the protective cover having at least one slit in the rear portion of the protective cover to allow access to the hearing aid.

Turning now to FIGS. 9 and 10, in at least one additional optional embodiment, protective glove or envelope 20 optionally comprises a longitudinal slit 91 at the rear of hearing aid device 10 rather than a transverse slit. It will be appreciated that longitudinal slit 91 is optionally sized and located to allow access to the rear portion of hearing aid device 10, or may be sized such that the rear portion of hearing aid device 10 is allowed to be pulled through the opening formed by longitudinal slit 10 when the edges are rolled back.

While specific embodiments have been disclosed herein, combinations of those embodiments, as well as certain variations thereof are included in the scope of this application.

What is claimed is:

1. A hearing aid protection apparatus comprising:

a. a substantially hollow body comprising a water-resistant material;

b. the substantially hollow body having a first open end and a second substantially closed end, said hollow body sized and shaped to receive at least a portion of a hearing aid device through the first open end; and c. a transverse cut through the water-resistant material substantially bisecting the substantially hollow body, the transverse cut sized such that the substantially hollow body hinges between a front end and a rear end of the hollow body, thereby allowing the rear portion of the hollow body to be removably placed on a rear portion of the hearing aid device while the front end of the hollow body is maintained upon the hearing aid device.

2. The hearing aid protection apparatus of claim 1, wherein the water-resistant material is flexible or semi-flexible.

3. The hearing aid protection apparatus of claim 1, wherein the water-resistant material is selected from the group consisting of vinyl, rubber, neoprene, silicone rubber, neoprene, latex, and viton.

4. The hearing aid protection apparatus of claim 1, wherein the water-resistant material comprises a thickness of approximately 0.010" to approximately 0.040".

5. The hearing aid protection apparatus of claim 1, further comprising at least one hole formed through the water-resistant material, the at least one hole formed such that the transverse cut originates or ends within the hole.

6. The hearing aid protection apparatus of claim 1, further comprising a first hole and a second hole formed through the water-resistant material, the first hole formed in the substantially water-resistant material such that the transverse cut originates within the first hole, and the second hole formed in the substantially water-resistant material such that the transverse cut terminates within the second hole.

7. The hearing aid protection apparatus of claim 5, wherein the first and second hole are sized and shaped to correspond to a microphone port on the hearing aid device.

8. The hearing aid protection apparatus of claim 1, further comprising at least one raised area sized and shaped to receive a corresponding user control element from the hearing aid device when the substantially hollow body is placed over the hearing aid device.

9. The hearing aid protection apparatus of claim 1, wherein the first open end is shaped at an angle to a substantially longitudinal axis running through the substantially hollow body such that the hearing aid device may be inserted through the first open end without the use of a tool.

10. The hearing aid protection apparatus of claim 1, wherein the transverse cut through the water-resistant material produces an opening in the hollow body such that the hearing aid device may be inserted through the opening in the hollow body without the use of a tool.

11. The hearing aid protection apparatus of claim 1, further including at least one opening formed in the water-resistant material, the at least one opening sized to correspond to a microphone port on the hearing aid device, the at least one opening further shaped such that the opening is directed in a predetermined position to substantially allow sound from the predetermined position to enter the water-resistant material.

12. The hearing aid protection apparatus of claim 1, wherein the substantially closed end of the substantially hollow body substantially envelops the rear portion of the hearing aid device when the hearing aid protection apparatus is in a substantially closed position.

13. The hearing aid protection apparatus of claim 11, wherein the hearing aid protection apparatus is substantially impervious to water infiltration when the hearing aid protection apparatus is in the substantially closed position.

14. A hearing aid protection apparatus comprising:

a. a substantially hollow body comprising a water-resistant material having a thickness of approximately 0.010" to approximately 0.040";

b. the substantially hollow body having a first open end substantially sized and shaped to receive at least a portion of a hearing aid device, and a second substantially closed end operable to substantially envelop a rear portion of the hearing aid device; and c. a transverse cut through the water-resistant material substantially bisecting the substantially hollow body, the transverse cut sized such that the remaining water-resistant material forms a hinge in the substantially hollow body whereby the substantially closed end of the substantially hollow body may be flipped up to expose the rear portion of the hearing aid device while the first open end of the substantially hollow body is maintained around the hearing aid device.

15. The hearing aid protection apparatus of claim 14, wherein the water-resistant material is selected from the group consisting of vinyl, rubber, neoprene, silicone rubber, neoprene, latex, and viton.

16. The hearing aid protection apparatus of claim 14, further comprising a first hole and a second hole formed through the water-resistant material, the first hole formed in the substantially water-resistant material such that the transverse cut originates within the first hole, and the second hole formed in the substantially water-resistant material such that the transverse cut terminates within the second hole.

17. The hearing aid protection apparatus of claim 16, wherein the first and second hole are sized and shaped to correspond to a microphone port on the hearing aid device.

18. The hearing aid protection apparatus of claim 14, further comprising at least one raised area sized and shaped to receive a corresponding user control element from the hearing aid device when the substantially hollow body is placed over the hearing aid device.

19. The hearing aid protection apparatus of claim 14, wherein the first open end is shaped at an angle to a substantially longitudinal axis running through the substantially hollow body such that the hearing aid device may be inserted through the first open end without the use of a tool.

20. The hearing aid protection apparatus of claim 18, wherein the first open end is further shaped at an angle such that the substantially hollow body does not cover a microphone port on the hearing aid device.

21. The hearing aid protection apparatus of claim 14, wherein the hearing aid protection apparatus is substantially impervious to water infiltration when the substantially closed end of the substantially hollow body is not flipped up to expose the rear portion of the hearing aid device.

22. The hearing aid protection apparatus of claim 14, wherein at least one operational feature on the hearing aid device is accessible to a user when the substantially closed end of the substantially hollow body is flipped up to expose the rear portion of the hearing aid device.

23. A hearing aid protection apparatus comprising:

a. a substantially hollow body comprising a water-resistant material;

b. the substantially hollow body having a first substantially closed end and a second substantially closed end, said hollow body sized and shaped to envelop a hearing aid device within the hollow body; and c. a transverse cut through the water-resistant material substantially bisecting the substantially hollow body, the transverse cut sized such that the substantially hollow body hinges between a front end and a rear end of the hollow body, thereby allowing the hearing aid device to be inserted into the hollow body such that a front portion of the hearing aid device is enveloped within the hollow body, and the rear end of the hollow body may be removably placed on a rear portion of the hearing aid device while the front end of the hollow body is maintained upon the hearing aid device.

24. A hearing aid protection apparatus comprising:

a. a substantially hollow body comprising a water-resistant material;

b. the substantially hollow body having a first substantially closed end and a second substantially closed end, said hollow body sized and shaped to envelop a hearing aid device within the hollow body; and c. a longitudinal cut through the water-resistant material and sized and shaped to correspond to the size and shape of a rear portion of a hearing aid device, the longitudinal cut forming an opening in the water-resistant material such that a user may access the rear portion of the hearing aid device without removal of the hearing aid protection apparatus.

25. The hearing aid protection apparatus of claim 24, further including at least one opening formed in the water-resistant material, the at least one opening sized to correspond to a microphone port on the hearing aid device, the at least one opening further shaped such that the opening is directed in a predetermined position to substantially allow sound from the predetermined position to enter the water-resistant material.

26. The hearing aid protection apparatus of claim 25 wherein the at least one opening formed in the water-resistant material is formed on a raised surface in the water-resistant material.

* * * * *